US005118095A

United States Patent [19]

Flor

[11] Patent Number: 5,118,095

[45] Date of Patent: Jun. 2, 1992

[54] ADJUSTABLE EXERCISING STEP

[76] Inventor: Robert J. Flor, 3002 N. Kimberley Ct., Atlanta, Ga. 30340

[21] Appl. No.: 658,961

[22] Filed: Feb. 22, 1991

Related U.S. Application Data

[63] Continuation-in-part of Ser. No. 535,831, Jun. 11, 1990, Pat. No. 5,037,084.

[51] Int. Cl.[5] ..... A63B 5/00

[52] U.S. Cl. ..... 482/52; 248/346; 211/175; 182/46; 108/144

[58] Field of Search ..... 272/70, 70 A, 70.1, 272/70.2, 144; 248/346, 161; 211/175, 194; 182/46, 222; 108/106, 144

[56] References Cited

U.S. PATENT DOCUMENTS

| | | | |
|---|---|---|---|
| 314,831 | 3/1885 | Hardy | 108/144 |
| 2,496,758 | 2/1950 | Tingley | 248/346 |
| 3,586,306 | 6/1971 | Reece et al. | 248/161 |
| 4,046,348 | 9/1977 | Goodwin | 108/144 X |
| 4,159,826 | 7/1979 | Hancock | 272/65 |
| 4,549,767 | 10/1985 | Hampshire et al. | 297/439 |
| 4,624,341 | 11/1986 | Lee | 108/144 X |
| 4,852,691 | 8/1989 | Bruno | 182/46 X |
| 4,950,033 | 8/1990 | Anderson | 297/439 |

FOREIGN PATENT DOCUMENTS

| | | | |
|---|---|---|---|
| 2309222 | 8/1974 | Fed. Rep. of Germany | 272/65 |

*Primary Examiner*—Gene Mancene
*Assistant Examiner*—L. Thomas
*Attorney, Agent, or Firm*—James B. Middleton

[57] ABSTRACT

A step for performing exercises is polygonal or circular to allow approaches from any direction equally. The step has a base member and a platform member, the platform member being selectively adjustable with respect to the base. The base member has lands equally spaced around the base member at different heights, and the platform member has shoulders equally spaced around the platform member to be received on the lands. By selecting the proper lands for the shoulders, the height of the platform can be changed. Also, the platform member may be used without the base member for a lower height step. Preferably there are five shoulders and five lands in each group of lands for stability of the platform.

6 Claims, 2 Drawing Sheets

ADJUSTABLE EXERCISING STEP

CROSS-REFERENCE TO RELATED APPLICATION

This application is a continuation-in-part of the copending application of the same inventor, filed Jun. 11, 1990, under Ser. No. 535,831, now U.S. Pat. No. 5,037,084.

INFORMATION DISCLOSURE STATEMENT

It has long been recognized that the activity of walking up and down steps is a reasonably strenuous exercise. With this knowledge, there are many controlled exercises in which a person steps up one or two steps, and then steps down the same number. The use of the step has recently been incorporated into aerobic exercise programs.

A major difficulty in attempting to use the above mentioned stepping activity as a controlled exercise is that one rarely has steps appropriately available for the exercise. One person may be able to manage at home, but naturally occurring steps are rarely available for a class exercise. There has been some use of stadium bleachers, but these are not variable to conform to the desired level of activity, and some bleachers can be hazardous for such use. To overcome these difficulties, the prior art includes some steps, or benches, designed for use in exercising. One of these prior art devices is a step in usual form, but foldable so it can be stored when not in use. This device is disclosed in U.S. Pat. No. 3,035,671. Another prior art device is generally in the form of a small step ladder, the device being foldable for storage. This device is disclosed in U.S. Pat. No. 4,648,593. More recent apparatus includes an elongated platform having integral blocks under each end to raise the platform to the height of a step. Additional blocks are selectively receivable under the existing blocks to raise the platform further as may be desired.

Thus, all of the prior art exercising steps tend to be unwieldy to manipulate, and very limiting in exercises that can be performed with the devices.

SUMMARY OF THE INVENTION

This invention relates generally to exercise apparatus, and is more particularly concerned with an adjustable, portable step for use in aerobic exercise.

The present invention provides a step having at least one predetermined height, and being generally circular in plan view. Height adjusting means is self-contained so the user can select the desired height without the addition or subtraction of other members. Because all transverse dimensions are substantially equal, the exercise can be performed without regard for the particular direction the device is approached; and, one can change directions during the exercise without difficulty.

In the preferred embodiment of the invention, the device is circular, so all transverse dimensions are precisely equal; however, it will be recognized that an octagon, a hexagon, or even a square will serve the same general purpose in that the transverse dimensions are near enough to being equal that one can approach the step from any direction. The step includes a base member to be supported on the floor, and a platform member selectively receivable on, and adjustable with respect to, the base member. A plurality of lands on the base selectively supports the platform with respect to the base, and selection of different groups of lands varies the height of the platform with respect to the floor.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
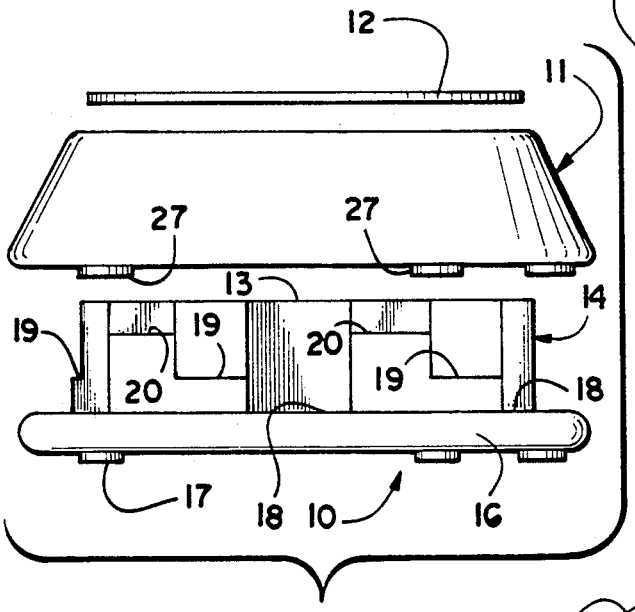
FIG. 1 is a front elevational view showing an exercising step made in accordance with the present invention, the platform member being shown exploded from the base member.

Referring now more particularly to the drawings, and to that embodiment of the invention here presented by way of illustration, the device shown in FIG. 1 of the drawings includes a base member generally designated at 10, a platform member generally designated at 11, and a platform mat generally designated at 12. As is better shown in FIG. 2, the base member 10 is generally circular in plan view and includes a body 14 having a central, axial opening 15. The outer surface of the body defines a plurality of lands designated at 18, 19 and 20. As will be better understood hereinafter, there are five of each of the lands 18, five of the lands 19 and five of the lands 20. The base member 10 further includes a bottom flange 16. Portions of this flange constitute the lands 18. The lower surface of the bottom flange 16 carries a plurality of feet 17.

The platform member 11 includes a skirt 21 surrounding an upper platform 22. The upper platform 22 is slightly recessed below the upper edge of the skirt 21. This recessed area receives the platform mat 12. It is contemplated that the mat 12 will be secured to the support platform 22 by any known means. One might utilize an adhesive, or the mat may be thermally welded or sealed to the platform member 11, and of course various mechanical fasteners might be used if desired.

The platform member 11 includes a plurality of shoulders 25 that are selectively receivable on the lands 18, 19 or 20. This arrangement will be discussed in more detail hereinafter.

With the above description in mind, it should be understood generally that the platform member 11 is received over the base member 10. The shoulders 25 are received on a selected group of the lands 18, 19 or 20. All of the shoulders 25 are the same distance from the upper platform 22, while the lands 18, 19 and 20 are different heights from the supporting surface. The result is that, depending on which group of lands is selected, the height of the upper platform 22 will be varied.

Figure 2:
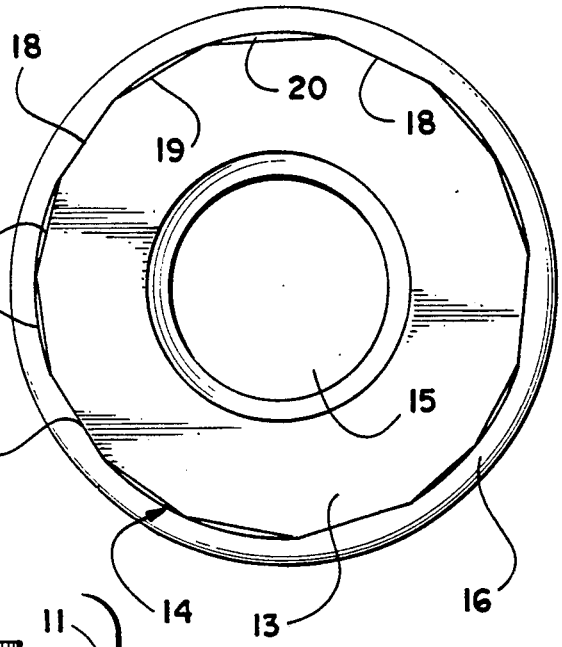
FIG. 2 is a top plan view of the base member illustrated in FIG. 1.
Figure 3:
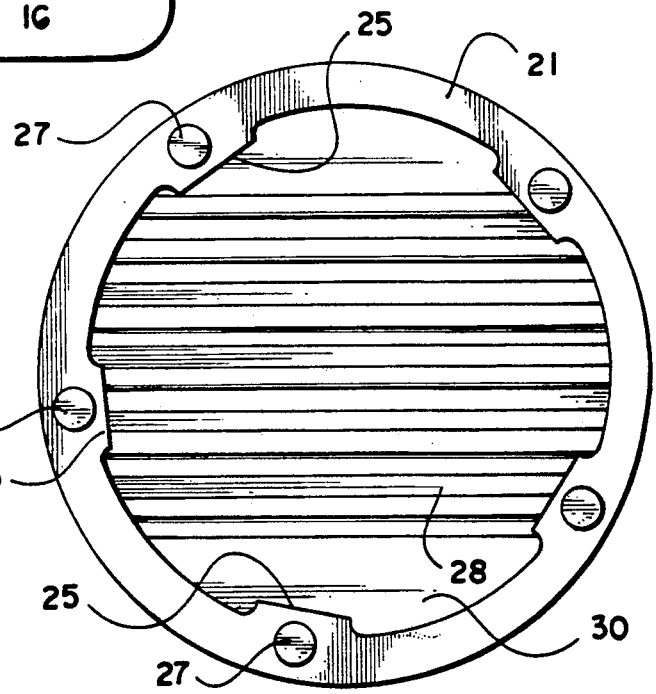
FIG. 3 is a bottom plan view of the platform member illustrated in FIG. 1; and, FIG. 4 is a view similar to FIG. 1, but showing the device in diametrical cross-section.

Attention is next directed to FIGS. 2 and 3 of the drawings. FIG. 2 is a top plan view of the base member 10, and FIG. 3 is a bottom plan view of the platform member 11. Thus, the various means for interlocking the base member 10 and the platform member 11 are shown in their true shapes.

In FIG. 2 it will be seen that the bottom flange 16 is circular and extends beyond the body 14 in all directions. In plan view, the body 14 appears to be generally circular, except that five segments have been removed. The five segments define the lands 18. The lands 19 and 20 are above the flange 16, but below the upper surface 13 of the body 14, and these lands are indicated in FIG. 2. Thus, each group of lands is equi-angularly distributed around the circumference of the body 14.

FIG. 3 shows the bottom of the platform member 11. Here it will be noted that the bottom surface of the skirt 21 is generally planar, surrounding a central cavity 30 within the platform member 11. The cavity 30 is generally circular, except that the five shoulders 25 are inwardly of the circle, defined as chords of a slightly smaller circle. The shoulders 25 are equi-angularly spaced around the cavity 30. In the area of each of the shoulders 25 there is a foot 27.

From the above description it will be understood that the cavity 30 in the platform member 11 receives the body 14 of the base member 10, and the extent of overlap depends on the rotational position of the platform member 11 with respect to the base member 10. If the shoulders 25 are aligned with the lands 18, the entire body 14 will be received within the cavity 30 and the shoulders 25 will rest on the lands 18, or the flange 16. By lifting the platform member 11 and rotating the member 24°, the shoulders 25 will be received on the next group of lands 19. Again, there are five of the lands 19 and five of the shoulders 25, equally spaced around the device, so the platform member 11 will be stably supported by the base member 10. Further lifting of the platform member 11 and rotation another 24° will cause the shoulders 25 to rest on the lands 20.

It will therefore be understood that the base member 10 provides five sets of lands 18, 19 and 20, each group of lands being at a different height from the supporting surface, and all lands within each group of lands are at the same height. As a result, the step of the present invention can be set at one height, and by simply raising the platform member 11 and rotating it by 24°, the height of the step, specifically the upper platform 22, will be varied. A fourth height of the step is available by using the platform member 11 without the base member 10. The height of the upper platform 22 will then be equal to the height of the platform member 11, or the distance from the bottom of the platform member 11 to the upper platform 22.

Those skilled in the art will realize that the device of the present invention may be made with groups of lands other than five. While a workable device can be made with fewer lands in each group, the group of five has been chosen for stability without excessively diminishing the size of the individual lands. If only three lands are used in each group, it will be understood that one may be able to tip the platform by stepping on the edge, between two lands. In the opposite extreme, as more equal-length facets are added to the circle, the size of the segments will necessarily decrease, yielding a smaller area to carry the shoulders 25. Thus, the use of five lands in each group of lands is thought to be the most desirable, but not the only usable number.

Looking a the structure of the base member 10 and the platform member 11, it will be understood by those skilled in the art that the members may be blow molded. Many different polymers may be used, such as a polyolefin, or a polycarbonate. More sophisticated resins may be used, but the cost would be higher, and the better resins should not be required for a good quality product made in accordance with the present invention. It is contemplated that a high density polyethylene will be utilized. Further, those skilled in the art will readily recognize that the device may be made of wood for a very nice but expensive version, and may be made of aluminum or other metals if desired.

Figure 4:
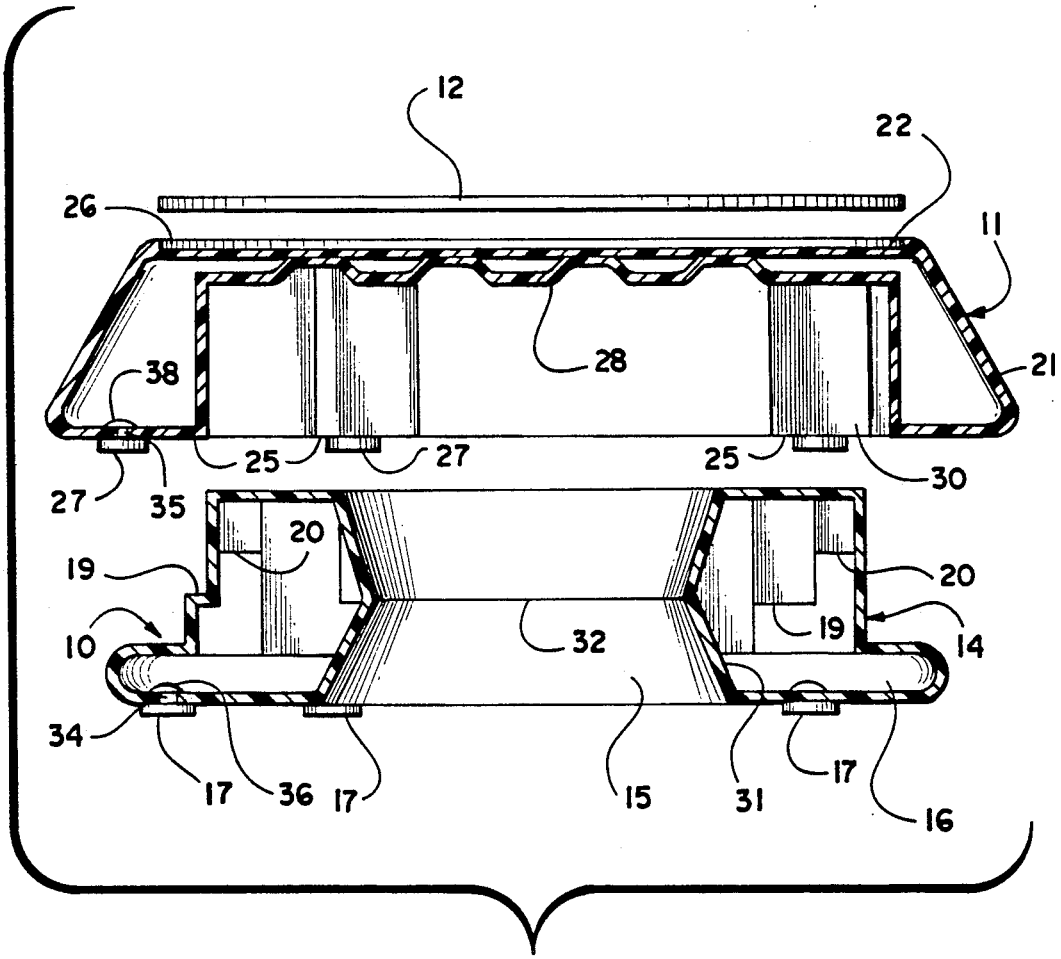

FIG. 4 of the drawings shows the base member 10 and the platform member 11 in diametrical cross-section, and positioned so the shoulders 25 will rest on the lands 19. The cross-section shows the interior of the device to illustrate that the device is hollow inside, and is constructed to be blow molded. Even using a relatively inexpensive plastic such as polyethylene, the blow molded device will have sufficient strength, and of course the hollow interior reduces the weight of the parts.

FIG. 4 of the drawings shows the recessed area 26, and the drawing includes the mat 12 for completeness. The mat 12 may be of conventional construction, and no further description is thought to be necessary.

The platform member 11 is a thin-walled structure including an outer wall which defines the external portion of the platform member 11, and an inner wall which defines the cavity 30. It will therefore be understood that the inner wall is shaped to define the shoulders 25.

The inner wall of the platform member 11, adjacent to the platform 22, is corrugated at 28 to add strength to the platform 22. The corrugations 28 are also shown in FIG. 3 of the drawings where it will be seen that they extend completely across the platform 22 centrally thereof.

The base member 10 as shown in FIG. 4 comprises a hollow body with the hole 15 therethrough defined by walls 31. It will be seen that the flange 16 has enough thickness to be hollow, and the body 14 extends upwardly therefrom. The hole 15 through the body 14 is defined by angled walls 31, the hole 15 having a smaller diameter centrally of the body 14 as indicated at 32. This provides a good draft angle for ease in blow molding and ease in removal from the mold.

The cavity 30 of the platform member 11 and the body 14 of the platform member 10 are here illustrated as having vertical walls. Though vertical walls are desirable, and may be used if the device is fabricated or machined, it is contemplated that the walls will be slightly tapered, again providing a draft angle for removal of the finished pieces from the mold.

While the feet 17 and 27 may be provided in many ways, as here shown the feet 17 and 27 include necks 34 and 35 respectively that pass through holes in the base and platform members respectively. Heads 36 and 38 respectively secure the feet in place. This construction is known to those skilled in the art and no further discussion should be necessary.

With the above description in mind, it will be understood that the step of the present invention is convenient and versatile. For simple stepping exercise the device is easily available and adjustable in height. For very young people and very old people, the device may be small, allowing a low step, with some increase in height for more strenuousness. For people between the extremes, the device may have reasonable height at its lowest, and be capable of being raised for an even more strenuous exercise.

Regardless of the height selected, it will be understood that many exercises can be done with the step. In modern aerobics, part of the effort is to make the exercise fun for the participants. With small children, there is an effort to make the children think of the exercise as a dance or a game in order to hold their interest. With adults, there is an effort to make the exercise simulate dancing, or otherwise try to make the exercise fun, so many different steps and techniques are utilized. The prior art elongated steps, or benches, are very limiting in the dance steps, or approaches to the device. The device of the present invention, however, has all transverse dimensions generally equal, so is substantially the same from any direction of approach and allows great variation in the activities. The embodiment here presented is circular, so all transverse dimensions are diameters of a circle and are precisely equal.

The device of the present invention can be made in almost any size to suit the age and agility of the person using the device. It is contemplated, however, that a general purpose device for the average age-range may have a diameter of about two feet, with heights of around 8, 9½, and 11 inches. By omitting the base member 10, the height may be about 6½ inches. Both the bottom flange 16 and the skirt 21 are provided with non-skid feet for safety in use.

It will of course be understood by those skilled in the art that the particular embodiment of the invention herein disclosed is by way of illustration only, and is meant to be in no way restrictive; therefore, numerous changes and modifications may be made, and the full use of equivalents resorted to, without departing from the spirit or scope of the invention as outlined in the appended claims.

I claim:

1. An exercising step for use in aerobic exercise, said exercising step comprising a base member and a platform member, said platform member being selectively receivable on said base member and including an upper platform to receive the feet of a person exercising, and a skirt surrounding said upper platform, and means for varying the height of said platform member with respect to said base member for varying the height of said upper platform, said platform member having generally the same dimension in all transverse directions, said platform member defining a cavity therein within the confines of said skirt, the arrangement being such that said person steps on said upper platform in performing said aerobic exercise, said base member including a body, said body being selectively receivable within said cavity of said platform member, the arrangement being such that said means for varying the height of said platform member with respect to said base member selectively varies the extent to which said body is received within said cavity.

2. An exercising step as claimed in claim 1, said means for varying the height of said platform member including a plurality of groups of lands on said base member, said lands being spaced around said base member, and a plurality of shoulders on said platform member, said plurality of shoulders being spaced around said platform member and selectively receivable on one group of said plurality of groups of lands, each group of lands of said plurality of groups of lands being at a different height from a supporting surface for said base member.

3. An exercising step as claimed in claim 2, said base member being generally circular and including a bottom flange, each land of said plurality of groups of lands comprising a segment of said body, said body having an upper surface, each said group of lands being at a different distance from said upper surface of said body, each land within one group of lands being equiangularly spaced from other lands of said group, said platform member having a lower surface defining said plurality of shoulders, each shoulder of said plurality of shoulders being equiangularly spaced from the other shoulders of said plurality of shoulders, the arrangement being such that rotation of said platform member with respect to said base member aligns said plurality of shoulders with one group of said plurality of groups of lands for varying the height of said upper platform.

4. An exercising step as claimed in claim 3, wherein each said group of lands includes at least three lands within said group, and said plurality of shoulders includes at least three shoulders.

5. An exercising step as claimed in claim 4, wherein each said group of lands comprises five lands within said group, and said plurality of shoulders comprises five shoulders.

6. An exercising step as claimed in claim 4, and further including a plurality of feet fixed to said platform member, said plurality of feet depending from said lower surface of said platform member.

* * * * *